US006425210B1

(12) United States Patent
Ricci

(10) Patent No.: US 6,425,210 B1
(45) Date of Patent: Jul. 30, 2002

(54) SLAT TENSIONING MECHANISM AND FRAME STRUCTURE FOR LOUVER ASSEMBLIES

(75) Inventor: Fernando Ricci, Montreal (CA)

(73) Assignee: Ricci Tools Inc., Montreal (CA)

( * ) Notice: Subject to any disclaimer, the term of this patent is extended or adjusted under 35 U.S.C. 154(b) by 0 days.

(21) Appl. No.: 09/795,328

(22) Filed: Mar. 1, 2001

(51) Int. Cl.[7] ..... E06B 1/04
(52) U.S. Cl. ..... 49/504; 52/656.9; 52/656.7
(58) Field of Search ..... 49/504, 74.1, 74.2, 49/74.4, 74.8, 74.9, 403; 52/656.9, 656.7, 656.6, 658; 188/19, 29, 57

(56) References Cited

U.S. PATENT DOCUMENTS 3,321,223 A * 5/1967 Snow et al.
3,784,043 A * 1/1974 Presnick ..... 220/4 F
3,866,380 A * 2/1975 Benson ..... 52/656
4,296,587 A * 10/1981 Berdan ..... 52/788
5,473,853 A * 12/1995 Guillemet et al. ..... 52/745.16
5,485,705 A * 1/1996 Guillemet ..... 52/656.9
5,625,992 A * 5/1997 Strick et al. ..... 52/656.9
5,778,598 A * 7/1998 Ohanesian ..... 49/74.1
5,921,056 A * 7/1999 Weiss et al. ..... 52/745.16
6,094,796 A * 8/2000 Biro ..... 29/463

* cited by examiner

*Primary Examiner*—Curtis A. Cohen
(74) *Attorney, Agent, or Firm*—Guy J. Houle; Ogilvy Renault

(57) ABSTRACT

A slat tensioning mechanism is provided for holding interconnected slats of a louver assembly in a desired angulated position. The slat tensioning mechanism comprises a housing having wheel positioning means for rotationally receiving a bearing wheel. The bearing wheel has an outer circumferential flat wall, and hub means adapted for securement to an end connector of a slat, whereby the bearing wheel and the slat rotate together. A tensioning arm assembly is pivotedly engaged to the housing and has an arm disposed at a predetermined location with respect to the outer circumferential flat wall of the bearing wheel. The arm has a friction surface at a free end thereof for applying a pressure on the outer circumferential flat wall of the bearing wheel for frictionally arresting the bearing wheel at the desired position. The slat tensioning mechanism is adapted to be disposed in an upright of the louver assembly. A cap is secured to an end portion of the upright of the louver assembly and has a button in its top surface adapted for snap-engagement with a corresponding groove of a window sill. A traction corner is provided for releasably assembling a pair of hollow frame members and provides adjustable mating engagement.

5 Claims, 8 Drawing Sheets

SLAT TENSIONING MECHANISM AND FRAME STRUCTURE FOR LOUVER ASSEMBLIES

FIELD OF THE INVENTION

The present invention relates to louver assemblies and, more particularly, to a slat tensioning mechanism for releasably holding slats at a desired angulated position in a frame opening and also to frame-structure improvements.

BACKGROUND OF THE INVENTION

Louver assemblies have been known to be used in conjunction with windows and doors. Louver assemblies generally consist of a plurality of slats pivotally mounted at opposed ends to vertical uprights of a frame. Louver assemblies are advantageous in preventing the light and, in some instances, rain or snow to pass therethrough, while allowing air circulation when the slats are open. The louver assemblies of interest have solid slats as opposed to blinds with cloth slats used mainly in conjunction with windows as an alternative to curtains. Louver assemblies with solid slats are usually mounted in a rigid framing. These louver assemblies have also been known to include mechanisms whereby the slats are interconnected in order for each of them to be pivotally set at a same determined position. In this way, the slats of the louver assembly may rotate from a closed position, wherein the slats are generally vertical, to a maximum opening position, wherein the slats are horizontal.

U.S. Pat. No. 4,643,081, issued on Feb. 17, 1987 to Vicinanza et al., discloses a louver system in which the slats are interconnected to pivot together such that they can all be set at a same determined position as described above. The interconnecting mechanism is enclosed within hollow body uprights, whereby it is hidden.

Systems have been provided to hold the slats when a desired positioning is achieved. For instance, U.S. Pat. No. 465,098, issued on Dec. 15, 1891 to Maule, discloses a window or door blind wherein slats are interconnected to pivot in concert. A knob is secured to the slat interconnection, whereby it translates up and down an upright of the window or door blind in response to a rotation of the slats. The knob is tapped and is operatingly engaged to a hidden threaded rod, such that the knob can be screwed downward to apply a pressure on the upright. Consequently, the slats can be locked in a desired position. U.S. Pat. No. 3,991,518, issued to Ishihara on Nov. 16, 1976 also discloses a similar locking system, with the difference being that the system is located at a bottom of the louver assembly and is fully visible.

Efforts have been made, as seen in the prior art, to enclose the slat interlocking systems in the uprights. This feature enhances the decorative appeal thereof. On the other hand, in the prior art, the slat locking mechanisms are not fully enclosed in the uprights and are not esthetically attractive. It would be desirable to hide the slat locking mechanism.

Also, the previously disclosed slat locking mechanisms each require a manual step for the locking of the slats in a desired position. As a result, if the slat opening needs to be changed a few times during the day due to climatic changes, a precious amount of time is lost by this unnecessary manual step.

Louvered frames of the prior art, whether they are hinged or releasably mounted to a window sill, are usually maintained in position in their window sill by attaching devices mounted to adjacent frame uprights and accessible interiorly of the frame. These attaching devices often break and are an eye sore.

It is also desirable to provide an effective and reliable traction assembly which is easy to install in the mating ends of the frame members and easy to adjust after the frame members are interconnected.

SUMMARY OF THE INVENTION

It is a feature of the present invention to provide a slat tensioning mechanism for releasably holding slats at a desired angulated position in a frame and which overcomes the above described disadvantages of the prior art.

It is a further feature of the present invention to provide an upright cap comprising snap-engagement means for maintaining a louver assembly in position in a window sill.

It is still a further feature of the present invention to provide a traction corner for facilitating the assembly of frame members of a louver assembly.

According to the above features of the present invention, from a broad aspect, the present invention provides a slat tensioning mechanism for holding interconnected slats of a louver assembly in a desired angulated position. The slat tensioning mechanism comprises a housing having wheel positioning means for rotationally receiving a bearing wheel. the bearing wheel has an outer circumferential flat wall, and hub means adapted for securement to an end connector of a slat, whereby the bearing wheel and the slat rotate together. A tensioning arm assembly is pivotedly engaged to the housing and has an arm disposed at a predetermined location with respect to the outer Circumferential flat wall of the bearing wheel. The arm has a friction surface at a free end thereof for applying a pressure on the outer circumferential flat wall of the bearing wheel for frictionally arresting the bearing wheel at the desired position. The slat tensioning mechanism is adapted to be disposed in an upright of the louver assembly.

According to a further broad aspect of the present invention, there is provided a cap adapted for covering an end portion of an upright of a louver assembly. The cap comprises a top surface and a bottom surface, and connection means for releasably securing the cap to the end portion of the upright. A button protrudes from the top surface and is adapted for snap-engagement with a corresponding groove of a window sill, whereby the louver assembly is releasably engagable to the window sill.

According to a still further broad aspect of the present invention, there is provided a traction corner for releasably assembling a pair of hollow members having corresponding obliquely cut faces. The traction corner comprises a right-angle body having a pair of arms. One of the arms is adapted to be inserted in one of the hollow members, the other of the arms is adapted to be inserted in the other of the hollow members. A connecting clip is disposed in the right-angle body having a pair of wings. Each of the wings has a hook portion at a free end thereof. The hook portions are adapted for captively engaging the wings in the hollow members, whereby the corresponding obliquely cut faces are face-to-face with a gap therebetween. An expansion mechanism is provided for exerting pressure against the junction of the pair of wings and against the right-angle body such that, with the wings being held captive in the hollow members, the free ends of the wings are displaced toward each other for joining the obliquely cut faces in co-planar engagement.

BRIEF DESCRIPTION OF THE DRAWINGS

The preferred embodiments of the present invention will now be described with reference to the accompanying drawings in which.

DESCRIPTION OF PREFERRED EMBODIMENTS

Figure 1:
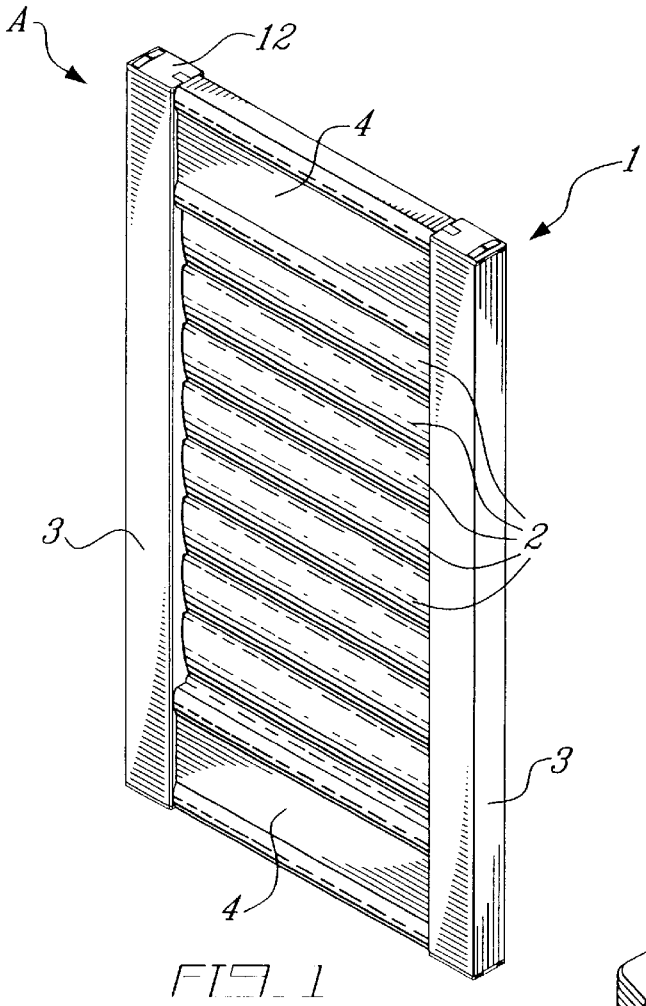
FIG. 1 is a perspective view of a louver assembly comprising a slat positioning system in accordance with the present invention.

Referring now to the drawings and more particularly to FIG. 1, a louver assembly is generally shown at 1. The louver assembly 1 comprises a slat tensioning mechanism constructed in accordance with the present invention and located in region A of the lover assembly 1. The slat tensioning device is not visible, but is adjustable through an upright end cap 12.

As known in the art, the louver assembly 1 is defined by a plurality of slats 2 mounted at opposed ends to a pair of frame uprights 3. The slats 2 are idle and enabled to pivot between the uprights 3. The uprights 3 are parallel and are spaced apart by transverse frame members 4. The uprights 3 consists of hollow channels, wherein a known mechanism is inserted, whereby the slats 2 are operatingly interconnected such that they remain parallel one to another while pivoting between the uprights 3. The hollow channels of the; uprights 3 are, for instance, of rectangular cross-section with one of the sides thereof being removable, such as to provide access for installation and maintenance of the slat interconnecting mechanism within one of the hollow vertical channels. The louver assembly 1 is adapted to be secured to a window sill, such that the light, rain or snow is prevented from passing through.

Figure 2:
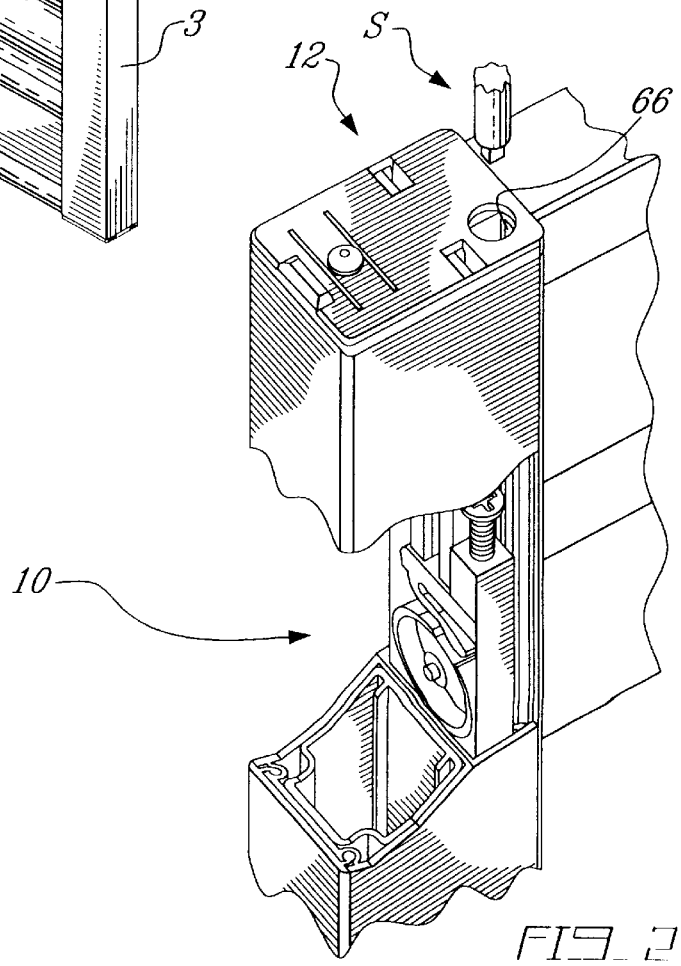
FIG. 2 is a perspective view, partly fragmented, of a slat tensioning device and an upright cap in accordance with the present invention.
Figure 3:
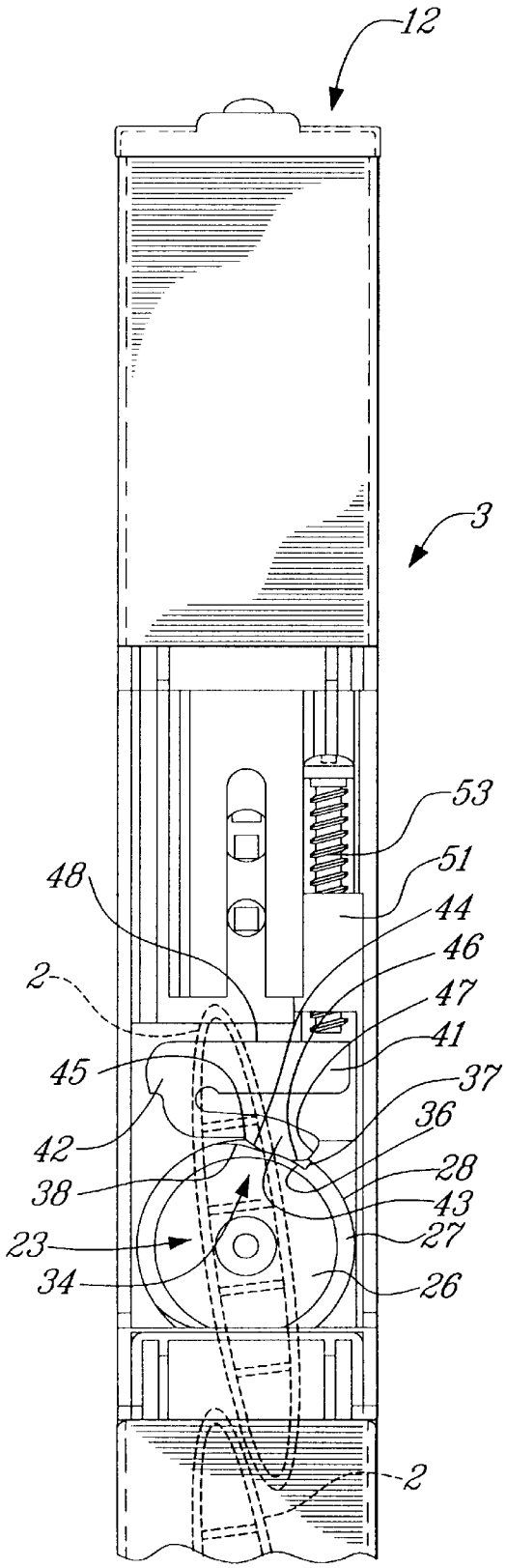
FIG. 3 is a side elevational view, partly fragmented, of the slat tensioning device and the upright cap.

Referring to FIGS. 2 and 3, the slat tensioning mechanism is generally shown at 10. The upright 3 has been partly fragmented in order to depict the positioning of the slat tensioning mechanism 10 therein. It is noted that the slat tensioning mechanism 10 bears an end of a slat 2, whereby the slat 2 is idle and enabled to rotate.

Figure 4:
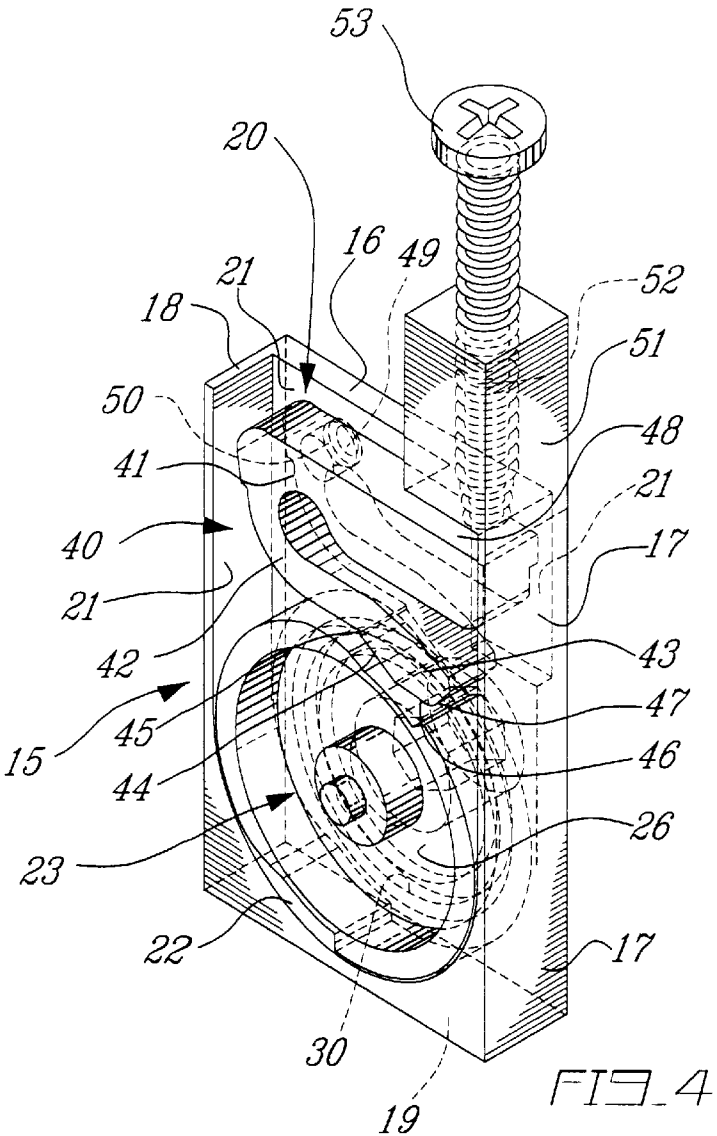
FIG. 4 is a perspective view of the slat tensioning device.

Referring now to FIG. 4, the slat tensioning mechanism 10 is shown having a casing 15 defined by a front wall 16, lateral walls 17 and 18 and a bottom surface 19. A cavity 20 is defined in the casing 15 and is bounded by the inner surfaces 21 of the front wall 16, the lateral walls 17 and 18, and by a substantially semi-circular surface 22 opposite the bottom surface 19 thereof. A circular opening 30 extends through the front wall 16 and is concentric with the semi-circular surface 22. The semi-circular surface 22 operatingly bears a wheel 23. A hole 50 extends through the front wall 16 at a top end thereof and adjacent the lateral wall 18.

Figure 5:
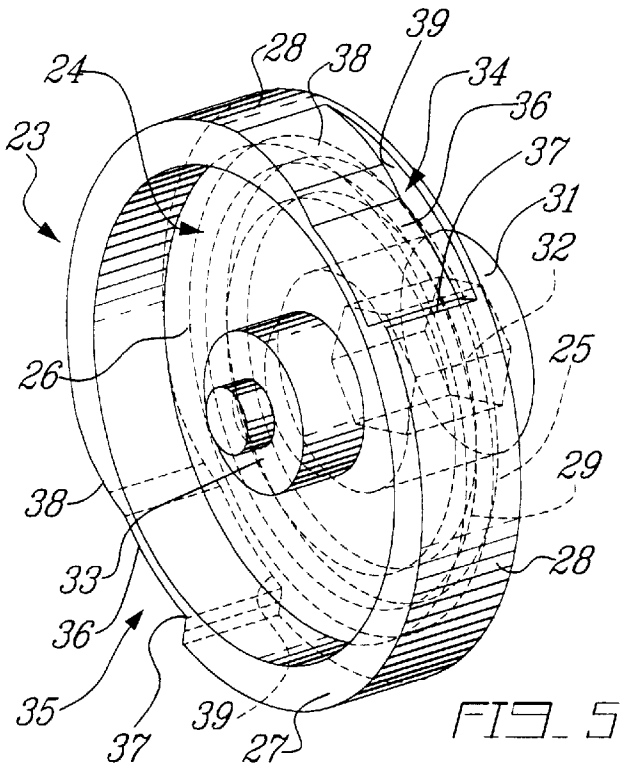
FIG. 5 is a perspective view of a wheel of the slat tensioning device.

As best shown in FIG. 5, the wheel 23 is defined by a disk 24 having a front surface 25 and a rear surface 26. An annular wall 27 laterally extends from the periphery of the disk 24. The annular wall 27 has an outer surface 28, whereby the wheel 23 is slidably engaged in the semi-circular surface 22 of the casing 15 as shown in FIGS. 2 to 4. Accordingly, the wheel 23 is idle and free to rotate in the casing 15.

The front surface 25 of the wheel 23 has an annular flange 29 laterally projecting therefrom. The annular flange 29 is circumferentially disposed on the front surface 25 of the wheel 23. When the wheel 23 is disposed in the casing 15, as depicted in FIGS. 2 to 4, the annular flange 29 corresponds with the circular opening 30 of the casing 15. Accordingly, when the casing 15 bears the wheel 23, they are slidably engaged by the corresponding semi-circular surface 22/annular wall 27 and circular opening 30/annular flange 29, whereby the wheel 23 is kept idle in the casing 15.

Returning now to FIG. 5, it can be seen that the front surface 25 of the wheel 23 has a hub 31 laterally projecting therefrom. The hub 31 is concentric with the wheel 23. The hub 31 defines an inner surface 32. The inner surface 32 is adapted for matingly receiving an end pivot (not shown) of a slat therein. For instance, the inner surface 32 of the wheel 23 of the preferred embodiment is defined by an hexagonal cross-section (for a corresponding hexagonal cross-section end pivot of the slat 2), such that a rotation of the slat is transmitted to the wheel 23, whereby the wheel 23 rotates about the casing 15, as explained above. A cylindrical block 33 is concentrically located on the rear surface 26, thereby structurally strengthening the disk 24.

The wheel 23 further comprises slots 34 and 35 in the outer surface 28 of the annular wall 27, whereby to limit the rotation of the wheel 23 about the casing 15, as will be explained hereinafter. The slots 34 and 35 are symmetrically identical. The slots 34 and 35 each comprise a bottom surface 36 bounded by a radially extending straight surface 37 and a sloped surface 38. Furthermore, a circular edge surface 39 ensures that there is no discontinuity in the sliding engagement surface of the perimeter of the wheel 23. It is noted that the elements co-operating in sliding engagement consist of materials suitable therefor (e.g. acetal for anti-friction and wear-resistant characteristics).

Referring to FIGS. 2 to 4, a tensioning member is generally shown at 40. The tensioning member 40 comprises a block portion 41 and a resilient arm 42 connected to an end of the block portion 41, such that the tensioning member 40 has a generally C-shape. The resilient arm 42 has a bulge 43 at a free end thereof. The bulge 43 has sloped portions 44 and 46, each connected to a straight portion 45 and 47, respectively. The block portion defines a planar top surface 48 and a pivot 49 laterally projecting from a side surface thereof. The tensioning member 40 is mounted to the casing 15 by the pivot 49 being interference fitted in the hole 50 of the front wall 16. The interference fit is such that a non-negligible amount of force needs to be applied to the tensioning member in order for the pivoting thereof about the casing 15.

As best seen in FIG. 4, a rectangular block 51 extends upward from the junction of the lateral wall 17 and the front wall 16 of the casing 15 and is integrally formed therewith. The rectangular block 51 has a tapped hole 52, operatingly receiving a bolt 53, whereby the vertical positioning of the bolt 53 may be varied. The rectangular block 51 and the tapped hole 52 are disposed on the casing 15 such that a bottom end of the bolt 53 may come into contact with a free end of the block portion 41 of the tensioning member 40. Consequently, the bolt 53 may be displaced downward in order to apply a pressure on the free end of the block portion 41. For instance, as seen in FIG. 2, a tooling end of a screwdriver S is shown on the verge of engaging with the bolt 53. The screwdriver S will be inserted through the upright cap 1, as will be explained hereinafter. As a result of the exerted pressure of the bolt 53, the tensioning member 40 may pivot about the hole 50 in the casing 15.

The tensioning member 40 is disposed in the casing 15 such that the bulge 43 of the resilient arm 42 is in contact with the wheel 23. Furthermore, the resilient arm 42 is biased such that the bulge 43 exerts a pressure on the wheel 23. The tensioning member consists of a material having, high memory characteristics (e.g. acetal). Accordingly, the bulge 43 will engage in the slots 34 and 35 when in corresponding positions. When either of the straight portions 45 and 47 of the bulge 43 abut the straight surface 37 of either one of the slots 34 and 35, the wheel 23 will be prevented from rotating in a direction. Therefore, the slats are limited in going from a vertical position, as shown in FIG. 3, wherein the bulge 43 is engaged in the slot 34, to a horizontal position, wherein the bulge 43 is engaged in the slot 35.

It is noted that the bulge 43 exerts a pressure on the outer surface 28 of the annular wall 27 when not inserted in either one of the slots 34 and 35. The exerted pressure may be such that the wheel 23, and thus the plurality of interconnected slats 2 of the louver assembly 1, may be arrested in a given position. Consequently, a person may choose a desired opening of the slats, which will be frictionally held by the action of the tensioning member 40 on the wheel 23, as explained above. If the pressure exerted by the tensioning member 40 is too small to hold the slats in a sloped position, the tensioning member 40 can be pivoted as explained above in order to exert more pressure. Similarly, pressure can be removed from the tensioning member, 40 by loosening the bolt 53.

The casing 15 is sized such that it is frictionally held in vertical position in the channel of the upright, as. seen in FIG. 3. On the other hand, it can be integrally formed in the upright 3. Consequently, no fastening elements nor bonding is necessary in order to secure, the slat tensioning device 10 therein. Furthermore, once a slat is inserted in the hub 31 as explained hereinabove, the vertical stability is ensured.

In order to have access to the bolt 53 to modify the pressure exerted on the tensioning member 40, known elements typical to louver assemblies have been modified. For instance, the upright cap 12 and the traction corner 11 have been modified in accordance with the present invention to provide bolt access for the adjustment of the slat tensioning device 10.

Referring to FIG. 2, the upright cap 12 in accordance with the present invention is shown mounted at a top of one of the uprights 3. It is noted that the upright cap 12 could have been disposed at a bottom end of the upright 3, wherein the slat tensioning device 10 would have been mounted to the lowest slat, with the bolt 53 thereof downwardly projecting.

Figures 6, 7, 8:
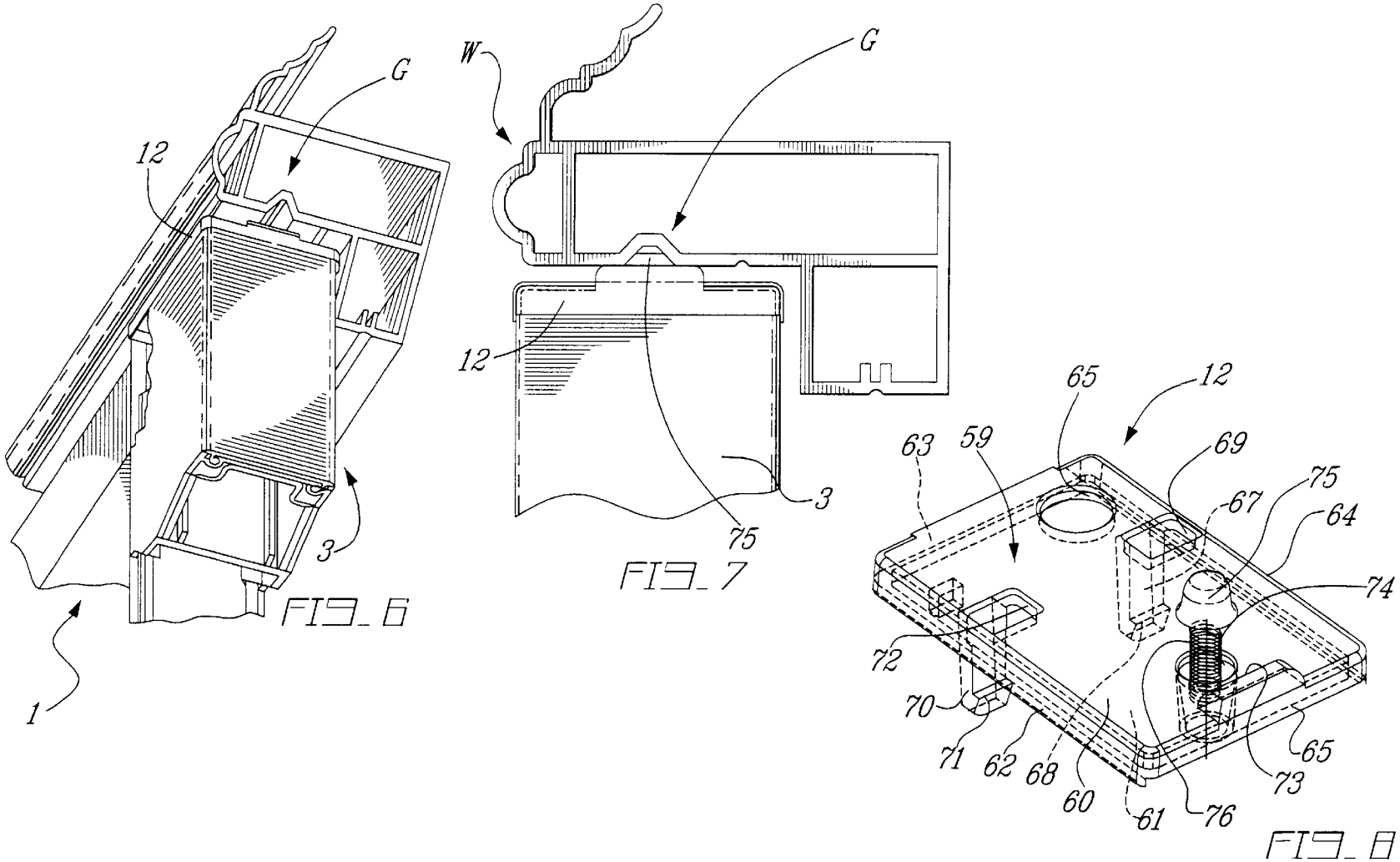
FIG. 6 is a perspective view, partly fragmented, of the upright cap releasably engaged on the framing of a window sill.
FIG. 7 is a schematic cross-sectional view of the upright cap releasably engaged in the window sill.
FIG. 8 is a perspective view of the upright cap.

Referring now to FIG. 8, the upright cap 12 is comprised of a generally rectangular plate 59 having a top surface 60 and a bottom surface 61. The edge walls 62, 63, 64 and 65 laterally project from the periphery of the bottom surface 61, whereby a downwardly facing cavity is formed. A through bore 66, adjacent the junction of the edge walls 64 and 65, extends from the top surface 60 to the bottom surface 61. A resilient finger 67, adjacent the edge wall 64 and generally in the middle of the cap 12, extends downwardly from the bottom surface 61. A hook portion 68 is formed at a free end of the resilient finger 67. Furthermore, a rectangular hole 69 extends from the top surface 60 to the bottom surface 61 of the cap 12 at the foot of the resilient finger 67, such that a tool may be inserted therein for deflecting the hook portion 68 of the resilient finger 67. Similarly, a resilient finger 70, identical to finger 67, is located adjacent the edge wall 62 in alignment with the resilient finger 67 and also has a hook portion 71 and a rectangular hole 72. A rib 73 extends upwardly from the top surface 60 and is located above the edge wall 63. The rib 73 serves structural purposes, whereby the upright cap 12 is strengthened.

The upright cap 12 further comprises a cylindrical receptacle 74 in the surface 61, adjacent the rib 73, for receiving a button 75 therein. The button 75 is upwardly biased, in this case by a compression spring 76, and may comprise a flange or the like at a bottom end thereof (not shown) such that it is kept in the receptacle 74. Returning now to, FIG. 2, the upright cap 12 is shown mounted on the upright 3 of the louver assembly 1. The upright cap 12 is dimensioned in order to have its edge walls 62, 63, 64 and 65 in a planar side-by-side relationship with the lateral walls defining the upright 3. As known in the art, the finger 67 and 70 engage in a releasable locking with receiving elements within the hollow body of the upright 3. The cap may be removed by deflecting the hook portions 68 and 71 of the resilient fingers 67 and 70, respectively, wherefore a lever is inserted in the rectangular holes 69 and 72. The upright cap 12 is disposed on the upright 3 such that the through bore 66 therein corresponds to the positioning of the bolt 53 of the slat tensioning device 10, whereby the tooling end of the screwdriver S may access the head of the bolt 53.

The upwardly biased button 75 of the upright cap 12 provides a louver assembly with snap-engagement means for the quick and easy retention and removal thereof upon a window sill. As seen in FIG. 1, the louver assembly 1 is small enough to be handled manually. For instance, the type of louver assembly depicted in FIG. 1 may be removed from a window sill W for maintenance purposes, such as for cleaning. As shown in FIG. 7, the button 75 is shown engaged in a corresponding groove G of the window sill W. FIG. 6 shows a different view of the engagement of the louver assembly 1 to the window sill. The button 75 of the upright cap 12 allows for the automatic snap-engagement thereof in the receiving groove G within the channel of the window sill. Whether the louver assembly is releasably secured to the window sill, whereby it can be completely removed therefrom, or it is hinged at an upright thereof to the window sill to rotate thereabout, no fastening elements are required to proceed with the snap-engagement thereof to the window sill.

It is pointed out that the spring biasing mechanism of the button 75 is not necessary for all instances. The upright cap 12 may be provided with a molded button (not shown) when a high stroke of deflection is not necessary. As the upright cap consist in a slightly resilient material (e.g. plastic), it can bend slightly to allow for the snap-engagement of its molded button in the corresponding groove of the window sill. In this case, the upright cap having a molded button does not require a receptacle such as receptacle 74.

As described above, the upright cap of the present invention is advantageous as it provides access to the tensioning bolt of the slat tensioning mechanism. Furthermore, the upright cap 12 does not require fasteners nor bonds, as opposed to the systems known in the art.

Also, magnets have been used to secure the louver assembly to the window sill. As magnets have been known to gradually lose their polarity over time, the snap-engagement button 75, either spring-biased or molded, provides a more durable solution. Finally, when the upright cap 12 is used in combination with the slat tensioning device, the resulting louver assembly comprises discreet features. As described above, once the louver assembly is mounted to the window sill, the through bore 66 in the upright cap is hidden, whereby no trace of the slat tensioning mechanism is apparent.

In order to assemble a pair of uprights to a transverse member, while using the slat tensioning device 10 of the present invention with the upright cap 12, the connecting means between the uprights and the transverse members must take into account that access must be provided between the through bore 66 of the upright cap 12 and the bolt 53 of the slat tensioning device 10.

Figure 9:
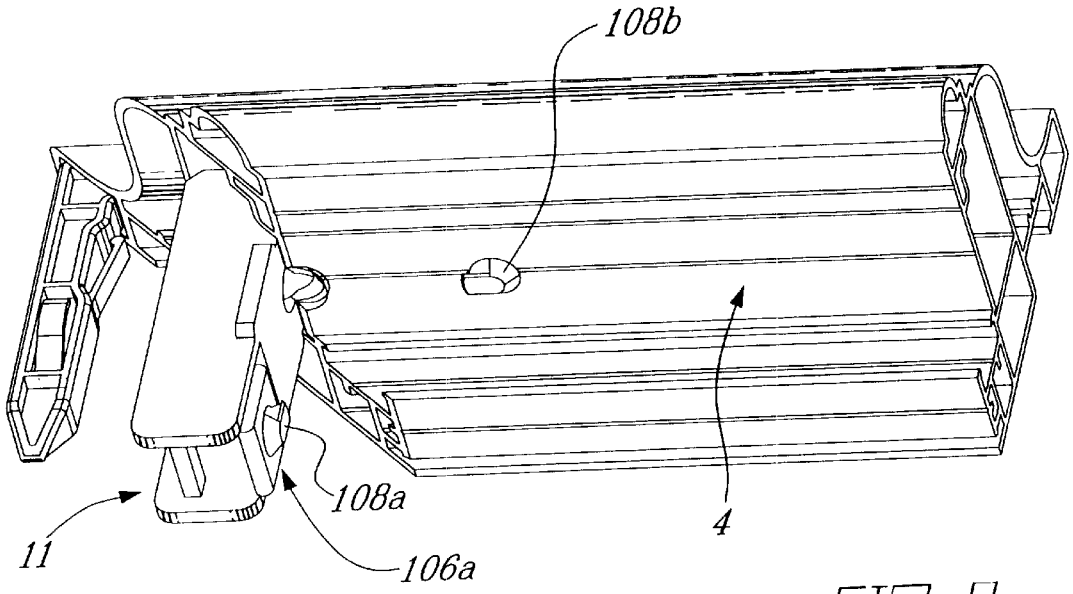
FIG. 9 is a perspective view, partly fragmented, of a traction corner mounted to a transverse member of the louver assembly in accordance with the present invention.
Figure 10:
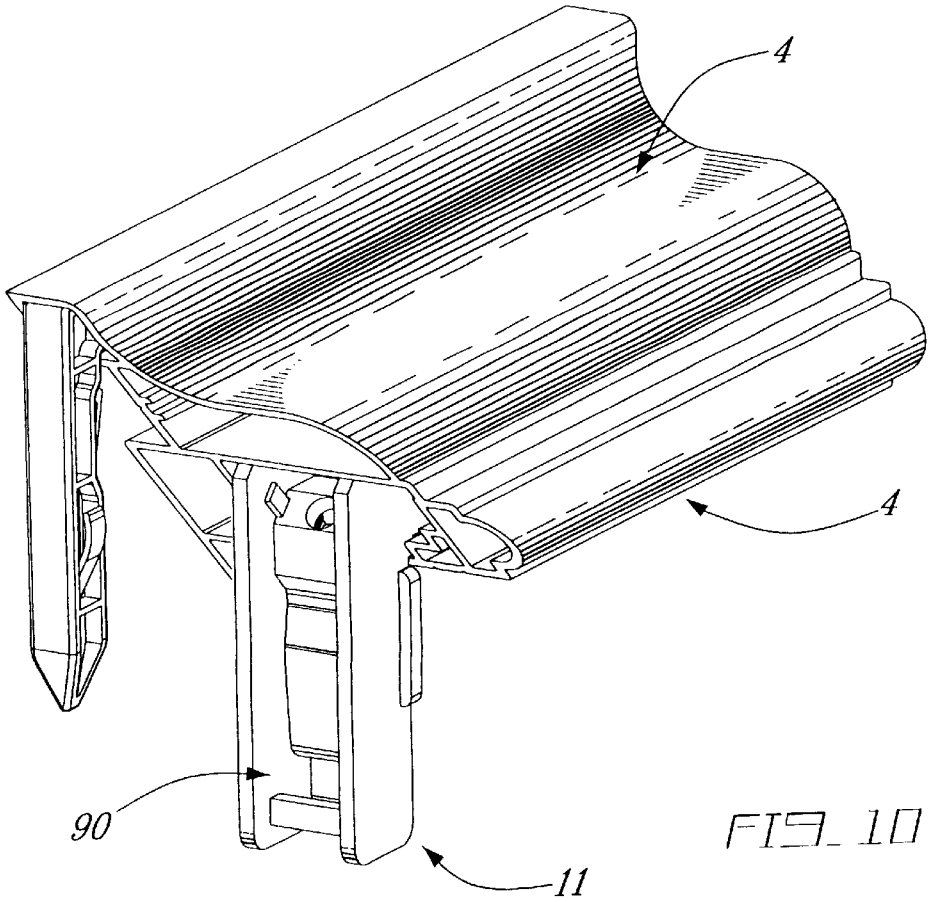
FIG. 10 is a further perspective view, partly fragmented, of FIG. 9.
Figure 14:
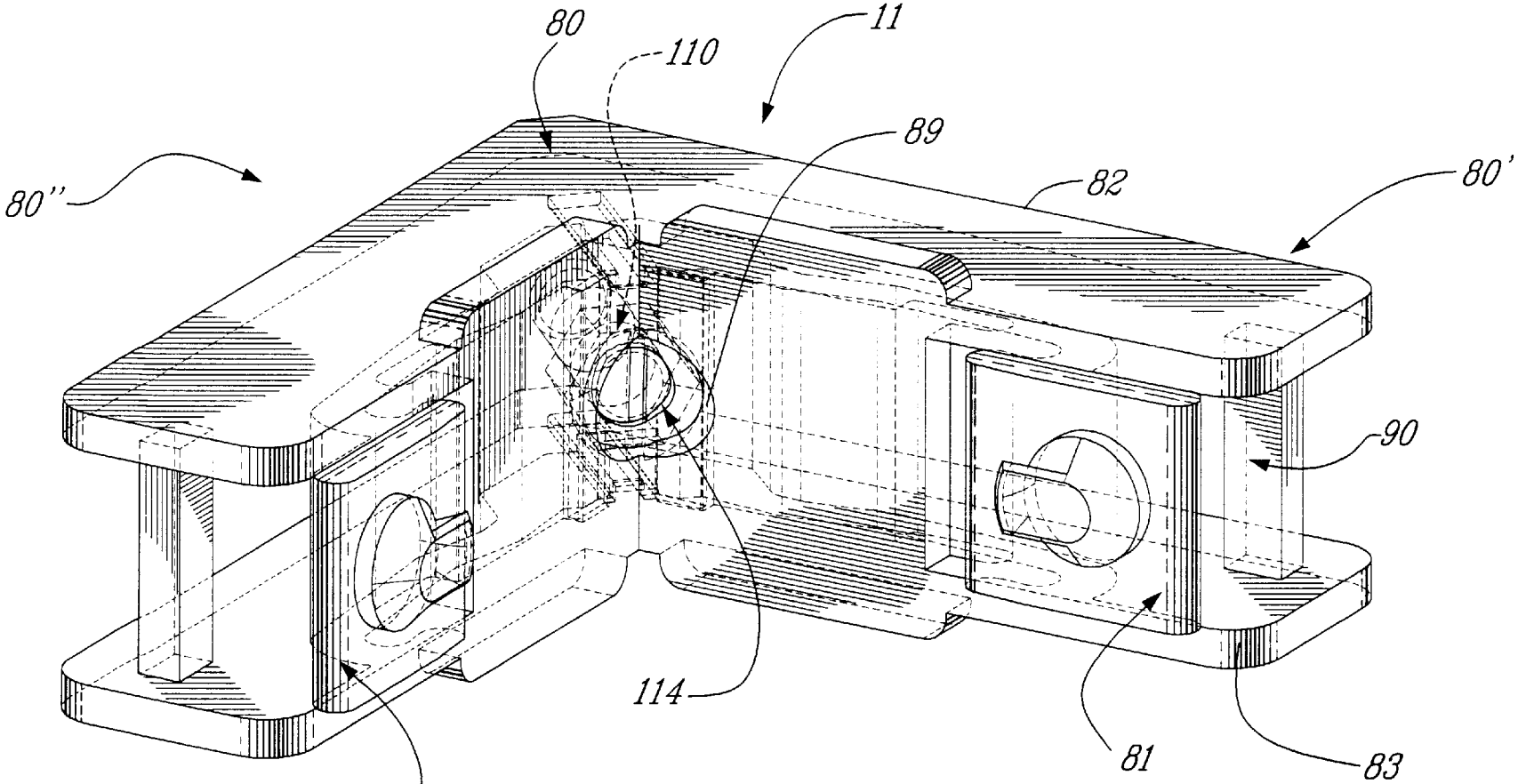
FIG. 14 is a perspective view of the traction corner.

A traction corner 11 is provided to connect an upright and. a transverse frame member each having corresponding obliquely cut ends. Referring to FIGS. 9 and 10, the traction corner 11 is shown mounted to a transverse member 4 having a 45 degree slant end face. As best shown in FIG. 14, the assembled traction corner 11 comprises a right angle connector body 80 and a traction connecting clip 81. More particularly, the connector body 80 and the traction connecting clip 81 are each shown individually in FIG. 11 and FIG. 12, respectively.

Figure 11:
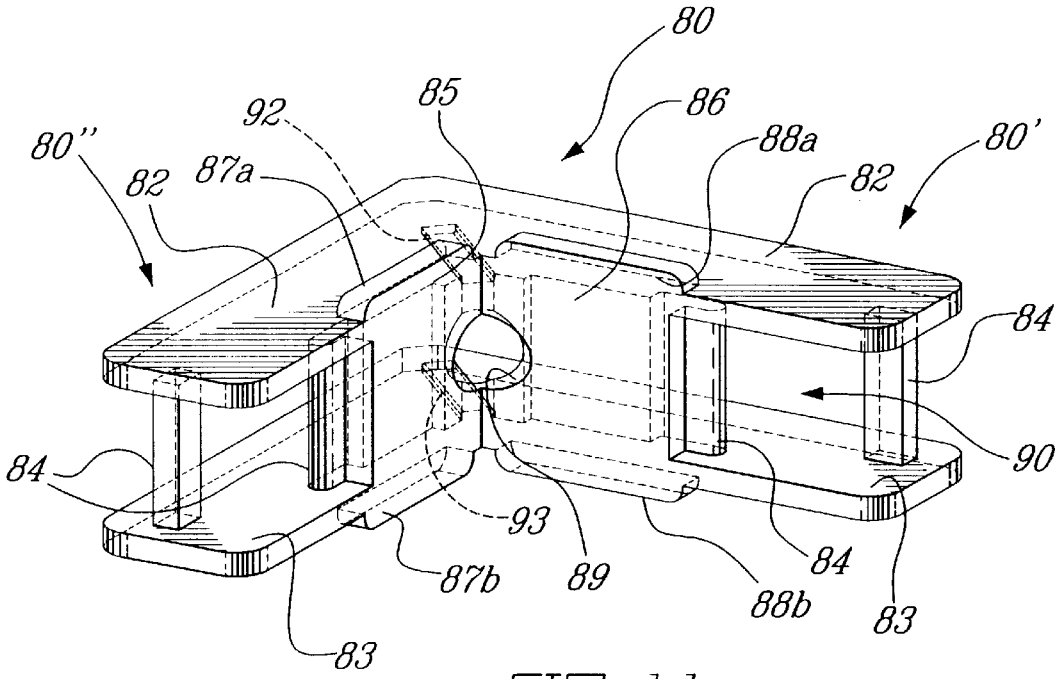
FIG. 11 is a perspective view of a housing element of the traction corner.

Referring to FIG. 11, the connector body 80 is comprised of a pair of arms 80' and 80", each arm having walls 82 and 83. The walls 82 and 83 are spaced apart by spacing posts 84 and form a gap 90 therebetween. A pair of transverse walls 85 and 86 are also connected to both the walls 82 and 83. The transverse walls 85 and 86 are interconnected at a right angle, and are located at the inside corner of the right angle of the connector body 80.

The transverse walls 85 and 86 project above and below the assembly of the walls 82 and 83, to form flanges 87*a* and 88*a* which laterally project from a top surface of the L-shaped wall 82, and flanges 87*b* and 88*b* which laterally extend from a bottom surface of the L-shaped wall 83.

A hole 89 extends through the junction of the transverse walls 85 and 86. Consequently, the hole 89 is centered at the inside corner of the right angle defined by the connector body 80.

A guide 92 protrudes from the surface of the wall 82 within the gap 90 and extends from the junction of the transverse walls 85 and 86 to the apex of the right angle connector body 80. Similarly, a guide 93 protrudes from the surface of the L-shaped wall 83 within the gap 90, and extends from the junction of the transverse walls 85 to 86 to the apex of the connector body 80. The guides 92 and 93 are substantially rectangular shaped.

Figure 12:
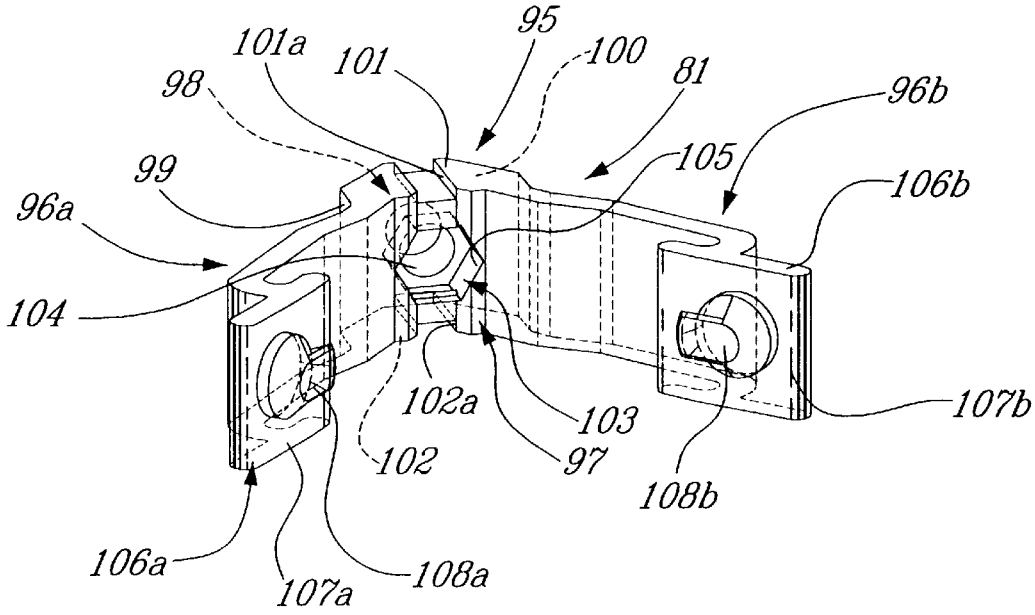
FIG. 12 is a perspective view of a pulling arm element of the traction corner.

Referring now to FIG. 12, the connecting clip 81 is comprised of a core portion 95 having a pair of opposed pulling arms 96*a* and 96*b*. The pulling arms 96*a* and 96*b* are identical. The core portion 95 is comprised of a generally rectangular block having a front surface 97, a rear surface 98, lateral side surfaces 99 and 100, and top and bottom surfaces 101 and 102, respectively. A hole 103 extends from the front surface 97 to the rear surface 98 and has a circular portion 104 open at the rear surface 98. The circular portion 104 connects to a hexagonal counterbore 105, the latter emerging in the front surface 97. A groove 101*a* is defined in the top surface 101 of the core portion 95, and extends from the front surface 97 to the rear surface 98. Similarly, a groove 102*a* is defined in the bottom surface 102, and extends from the top surface 97 to the rear surface 98.

The pulling arm 96*a* generally extends from the junction of the front surface 97 and the lateral side surface 99. Similarly, the pulling arm 96*b* generally extends from the junction of the front surface 97 and the lateral side surface 100. For simplicity, the pulling arm 96*a* will be described and like numerals affixed with a letter "b" on the pulling arm 97*b* in FIGS. 12 and 14 will designate equivalent elements. A head 106*a* is comprised at a free end of the pulling arm 96*a*. The head 106*a* has a square front surface 107*a* whereon a tooth 108*a* is located. The tooth 108*a* is generally centered about the square front surface 107*a* and is inwardly facing towards the core section 95.

Figure 13:
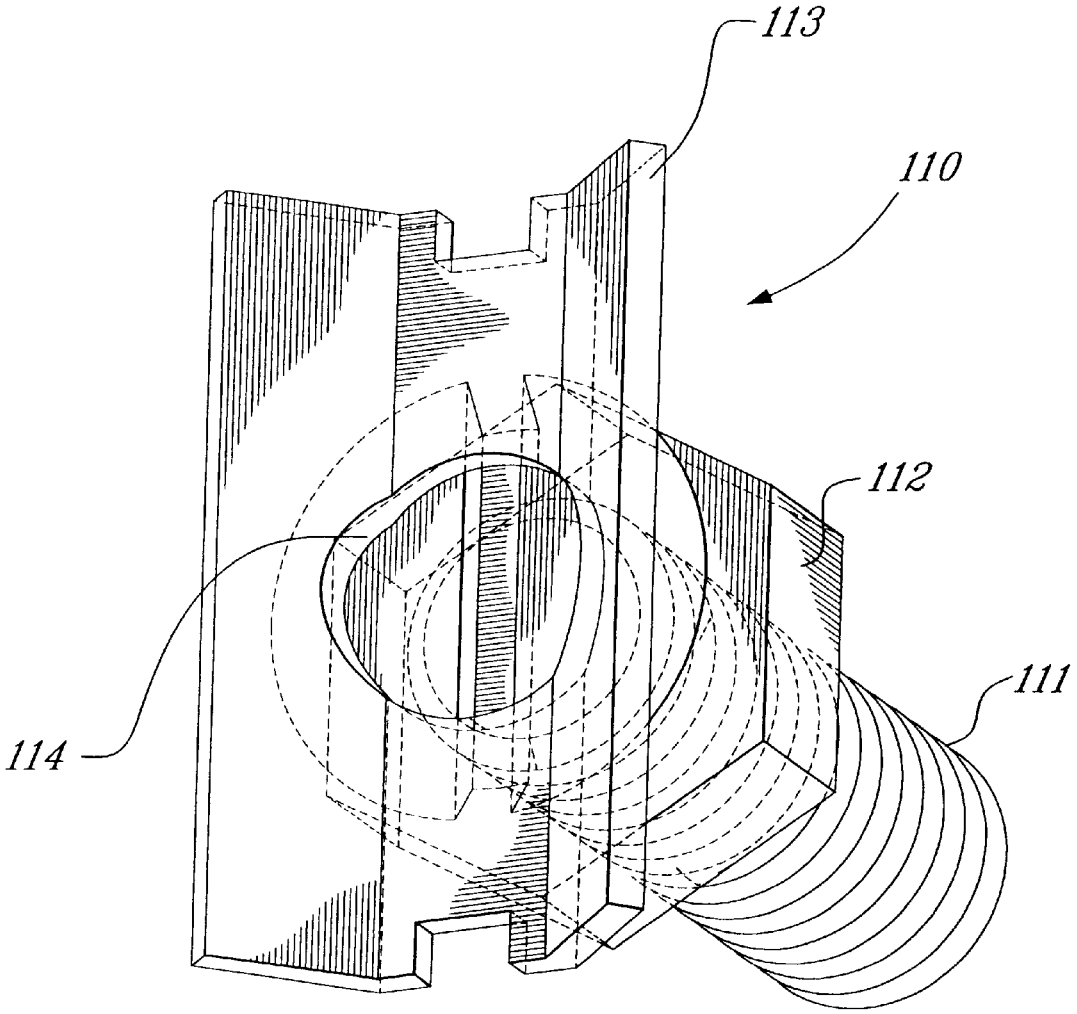
FIG. 13 is a perspective view of a pulling mechanism of the traction corner.

Referring now to FIG. 13, a pulling mechanism 110 is shown. The pulling mechanism 110 has a bolt 111 having a flat head, a hexagonal nut 112 operatingly engaged thereon, and a backing plate 113, abutting the flat head portion of the bolt 111. As depicted in FIG. 13, the backing plate 113 of the preferred embodiment is defined by a panel having a pair of slanted wings for planar engagement with the transverse walls 85 and 86 of the connector body 80, for purposes which will be explained hereinafter. A hole 114 is generally centered on the backing plate 113 and extends therethrough. The hole 114 is concentric with the flat head of the bolt 111, such that the tooling end of a screw driver can pass therethrough to operate the bolt 111. Furthermore, the hole 114 has a diameter smaller than the flat head of the bolt 111, such that the flat head and the backing plate 113 are always abutted, yet the bolt 111 turns independently of the backing plate 113. The backing plate 113 has a slot 115*a* in an upper edge thereof, and a slot 115*b* in a bottom edge thereof.

The pulling mechanism 110 is inserted in the connecting clip 81, with the nut 112 matingly engaged in the hexagonal counterbore 105, whereas the bolt 111 extends through the circular portion 104 thereof. Consequently, the bolt 111 may translate about the connecting clip 81 when rotated, whereas the nut 112 is secured thereto by the mating engagement.

Thereafter, the pulling mechanism 110/connecting clip 81 assembly, as described above, is inserted in the connector body 80. As shown in FIG. 14, this is achieved by the grooves 101*a* and 102*a* of the core portion 95 being slidably engaged in the guides 92 and 93 of the connector body 80, respectively. Similarly, the slots 115*a* and 115*b* of the backing plate 113 of the pulling mechanism 110 also slidably engage with the guides 92 and 93 of the connector body 80, respectively. Consequently, the backing plate 113 is sandwiched between the flat head end of the bolt 111 and the transverse walls 85 and 86 of the connector body 80.

The connecting clip 81 is free to slidably translate upon the guides 92 and 93 of the connector body 80. Also, the length of the pulling arms 96*a* and 96*b* is such that the square front surfaces 107A and 107B thereof extend outward of the gap 90, at opposed ends of the transverse walls 85 and 86, respectively. Finally, the core section 95 of the pulling arm element is positioned in the connector body 80 such that the flat head end of the bolt 111, and thus the hole 114 in the backing plate 113, are substantially concentric with the hole 89 at the junction of the transverse walls 85 and 86. The resulting assembly is the traction corner 11 of the present invention, as depicted in FIG. 14.

As shown in FIG. 9, the traction corner 11 is inserted in the obliquely cut end transverse member 4, which consists of hollow channels. It is noted that the transverse member 4 has a hole 4*a* defined therein. Accordingly, the traction corner 11 is slid in the hollow channel of the transverse member 4 until tooth 108*b* is captively engaged in the hole 4*a* thereof. The flanges 87*b* and 88*b* may be provided to obtain a mating slide in the hollow channels of the transverse member 4 according to the shape thereof. FIG. 10 illustrates a different view of the above described engagement.

Thereafter, an upright also having hollow channels (not shown) is joined to the free end of the traction corner 11, whereby the latter is captively engaged therein by its tooth 108*a*. As a result thereof, the obliquely cut ends of the upright and transverse member 4 are face-to-face and separated by a small gap. As partly seen in FIG. 9, corresponding semi-circular holes are provided in the transverse member and in the upright, whereby a tooling end of a screwdriver may operate the bolt 111 of the traction corner 11 when the latter is inserted in the transverse member and in the upright. The hole thereby formed is substantially concentric with the hole 89 of the traction corner 11.

When the bolt 111 is turned in one direction, the nut 112 and the flat head end of the bolt 111 will move in opposite directions, as readily known. Thus, the nut 112 will exert pressure against the core portion 95, whereas the flat head end will exert pressure on the backing plate 113 and thus the transverse walls 85 and 86 of the body 80. Consequently, the core section 95 will have a tendency to move. away from the transverse walls 85 and 86 as it translates on the guides 92 and 93. As the pulling arms 96*a* and 96*b* are connected to the upright and transverse members, respectively, they will move one towards the other, whereby pulling the upright and transverse member one towards the other. The bolt 111 is thus rotated until the obliquely cut ends of the upright end transverse member meet, whereby they are in coplanar engagement. Alternatively, the bolt 111 may be turned in the opposite direction in order to loosen the upright from the transverse member, whereby they can be separated and disassembled.

The traction corner 11 of the present invention is simple in construction, and simple in use as only one screw needs to be handled, thereby reducing the time usually necessary to mount such assemblies. The only tool required for the mounting thereof to obliquely cut frame members is a screwdriver. Furthermore, access to the tightening bolt is provided from the inside of the frame members, which means that the frame member can be tightened when they are installed on a window sill. Also, the traction corner 11 does not require much space within the frame members, whereby the remaining space can be used to provide screwdriver access to the slat tensioning device of the present invention.

It is within the ambit of the present invention to cover any obvious modifications of the embodiments described herein, provided such modifications fall within the scope of the appended claims.

I claim:

1. A traction corner for releasably assembling a pair of hollow frame members having corresponding obliquely cut faces, said traction corner comprising:

a right-angle body having a pair of arms, one of said arms being adapted to be inserted in one of said hollow frame members, the other of said arms being adapted to be inserted in the other of said hollow frame members;

a connecting clip captively retained in said right-angle body, said connecting clip having a pair of wings, each of said wings having a hook portion at a free end thereof, said hook portions being adapted for captively engaging said wings in said hollow frame members, whereby said corresponding obliquely cut faces are face-to-face with a gap therebetween;

an expansion mechanism connected to a corner of said right-angle body for exerting pressure against the junction of said pair of wings and against said right-angle body such that, with said wings being held captive in said hollow frame members, said free ends of said wings are displaced toward each other to pull said obliquely cut faces in tight co-planar engagement and under said exerted pressure of said expansion mechanism.

2. The traction corner according to claim 1, wherein said expansion mechanism may be reversed for displacing said free ends of said wings away from each other for separating said obliquely cut faces from co-planar engagement.

3. The traction corner according to claim 2, wherein said expansion mechanism is comprised of a nut matingly secured to said connector clip and a threaded bolt operatingly engaged therein.

4. The traction corner according to claim 1, wherein said expansion mechanism is accessed from the included angle of said right-angle body.

5. The traction corner according to claim 1, wherein said right-angle body comprises flange means outwardly projecting therefrom, said flange means adapted for sliding engagement with said hollow frame members.

* * * * *